US006997117B1

(12) United States Patent
Mitjans

(10) Patent No.: US 6,997,117 B1
(45) Date of Patent: Feb. 14, 2006

(54) STOWABLE LECTERN

(75) Inventor: José Figueras Mitjans, LLica d'Amunt (ES)

(73) Assignee: Figueras International Seating, S.A., Llica d'Amunt (ES)

( * ) Notice: Subject to any disclaimer, the term of this patent is extended or adjusted under 35 U.S.C. 154(b) by 0 days.

(21) Appl. No.: 10/182,443

(22) PCT Filed: Apr. 14, 2000

(86) PCT No.: PCT/ES00/00136

§ 371 (c)(1),
(2), (4) Date: Jul. 29, 2002

(87) PCT Pub. No.: WO01/56426

PCT Pub. Date: Aug. 9, 2001

(30) Foreign Application Priority Data

Feb. 1, 2000 (ES) ..... 200000204 U

(51) Int. Cl.
*A47B 13/02* (2006.01)

(52) U.S. Cl. ..... 108/150; 108/6; 108/50.02; 108/23

(58) Field of Classification Search ..... 108/23, 108/150, 50.01, 50.02, 6; 312/233; 248/346.01; 381/76, 82, 83
See application file for complete search history.

(56) References Cited

U.S. PATENT DOCUMENTS

| | | | | |
|---|---|---|---|---|
| 2,692,175 A | | 10/1954 | Jacques | |
| 3,319,001 A | * | 5/1967 | Sieler | 381/76 |
| 3,443,031 A | | 5/1969 | Bolick, Jr. | |
| 5,115,470 A | | 5/1992 | Sutheim | |
| 5,597,218 A | * | 1/1997 | Lechman | 248/346.01 |
| 5,615,620 A | * | 4/1997 | Owen | 108/45 |
| 5,638,758 A | * | 6/1997 | Carr | 108/50.02 |
| 5,974,984 A | | 11/1999 | Mitjans | |
| 5,979,337 A | * | 11/1999 | Clark et al. | 108/43 |

FOREIGN PATENT DOCUMENTS

| | | | |
|---|---|---|---|
| DE | 1554468 A | | 1/1970 |
| DE | 3740778 | * | 6/1989 |
| DE | 4309777 | | 9/1994 |
| EP | 0283459 | * | 3/1988 |
| FR | 808127 A | | 1/1937 |
| FR | 819293 | | 10/1937 |

* cited by examiner

*Primary Examiner*—Jose V. Chen
(74) *Attorney, Agent, or Firm*—Nath & Associates; Marvin C. Berkowitz; Derek Richmond

(57) ABSTRACT

Improved lectern table, made up of a bearing column (1) that rests on a base (2) to be fixed to the floor, while at its upper part it incorporates a board (3) situated in tiltable assembly, having on the rear of the column (1) a support (4) by way of an upwards directed arm on which a module (5) foreseen of a microphone (6) is situated which stands out above the board (3).

5 Claims, 5 Drawing Sheets

STOWABLE LECTERN

Referring to the armchairs installed in congress rooms, conference rooms and places having similar activities, the disposition of boards to be used as a support to place the documents which have to be managed and to ease up the taking of notes is usual.

A solution to this is the incorporation of folding boards in assembly on the arm-rest structures of the seats, which are generally very uncomfortable, due to the movement limitations and the burden they cause to the seat users.

Another well-known solution consists in situating boards with some type of folding assembly regarding the back of the seats, to be used by the users of the seats which correspondingly are located behind, which have a great application inconvenience, due to the staggered disposition in which the seats in successive rows are normally situated, so that the back of the seats does not correspond exactly in front of the respective seats situated behind.

In accordance with the present invention, a table lectern is proposed, in which the indicated inconveniences of the previously known solutions are eliminated in a practical way, bringing about some very advantageous features of application functionality.

This lectern table, object of the invention, consists in a supporting column foreseen of a fastening basis on the ground while at its upper part it has incorporated a board with a sliding articulating assembly, with the possibility to be tilted between an outstanding position respect to the column and a plied position behind the same, being incorporated fixed at the rear of the column a bearing support to hold a microphone bearing module.

The bearing column is made up of a profile which determines some longitudinal grooves at the sides, respect to which the articulated assembly and the sliding of the upper board is established by means of some fastening fittings, which determine the pivoting of the board between the deployed position in use and the vertical withdrawn position from behind the column.

This way a table is obtained which is very easy to install in the places of application, being able to be installed correspondingly in an appropriate way, before the seat to which it is destined, to be used with comfort.

This table is completely independent from the seats, so that it does not interfere with the respective use of the seat, avoiding thus the incommodity of the seat user, remaining the seat or seats located at the front completely independent from the table, so that between the mentioned table and the seats at the front there are no repercussions of movements, blows, etc. . . .

The withdrawal of the board behind the column, in its folded position, also allows to leave the space between the rows of seats completely free, easing up this way the movement between the mentioned rows of seats and for the cleaning jobs.

On the other hand, the incorporation of a microphone to the module also increases the benefits of the table since it allows oral interventions from the place of the table itself without interfering the inclusion of the mentioned microphone with the installation of the table in the corresponding place, nor to the installation of the same for its use and in the withdrawn form.

In view of all this, the mentioned table, object of the invention certainly has some very advantageous features, acquiring own life by itself and preferable character respect to the conventional solutions having the same function.

Figure 1:
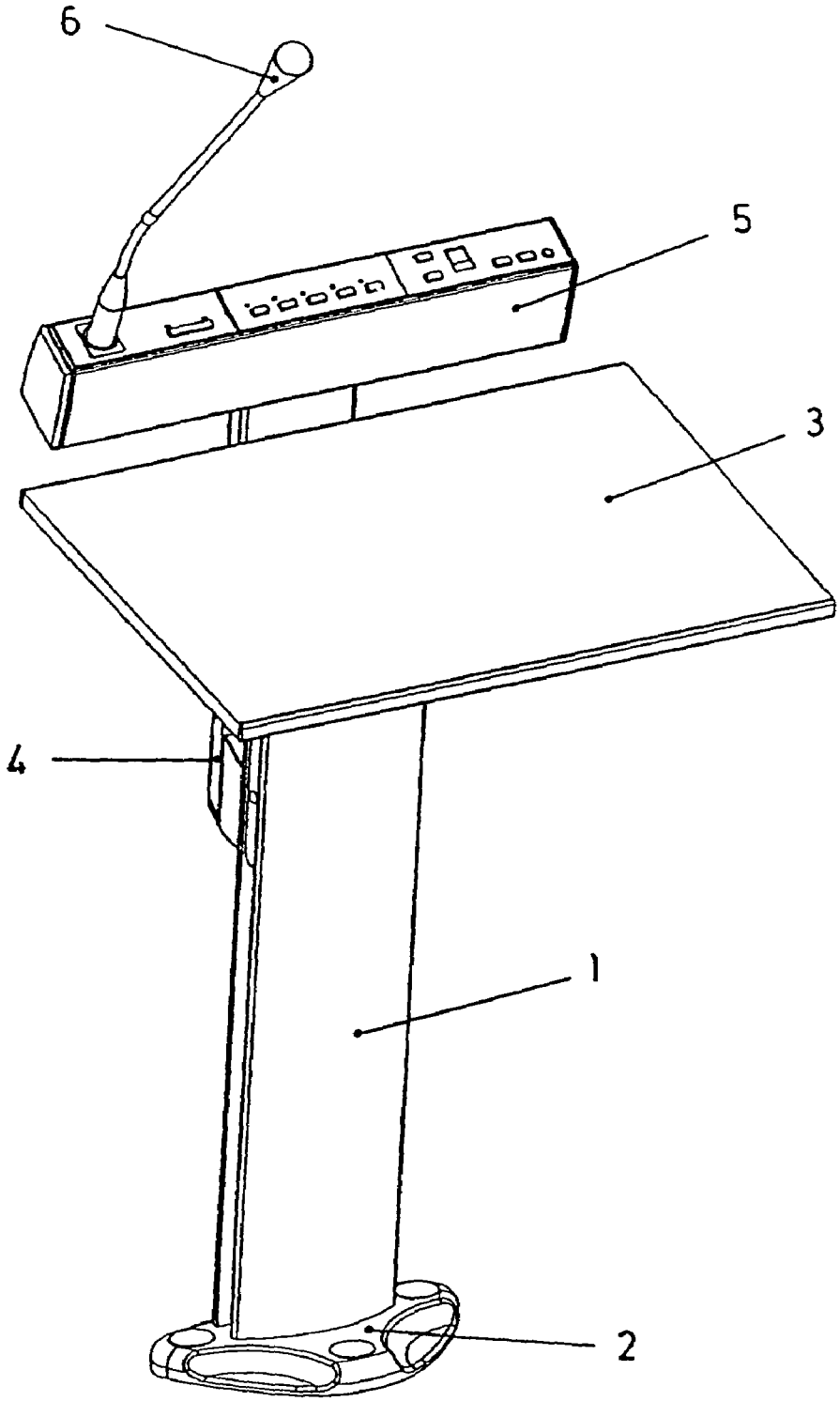
FIG. 1 shows a perspective of the preconized lectern table in its used or deployed position.

The object of the invention also refers to a lectern table which can serve for any oratorical place, being also applicable in an advantageous way in connection with the seats of conference rooms, of congress rooms, etc. . . .

The table consists in a bearing column (1), which includes a lower base (2) for its fixing onto the floor in the place of installation, while at its upper part it is made up of a board (3) situated in tiltable assembly.

At the rear of the column (1) itself there is moreover a support (4), in the shape of an arm directed upwards, on which a module (5) foreseen of a microphone (6) which remains situated conveniently above the board (3) is incorporated.

Figure 4:
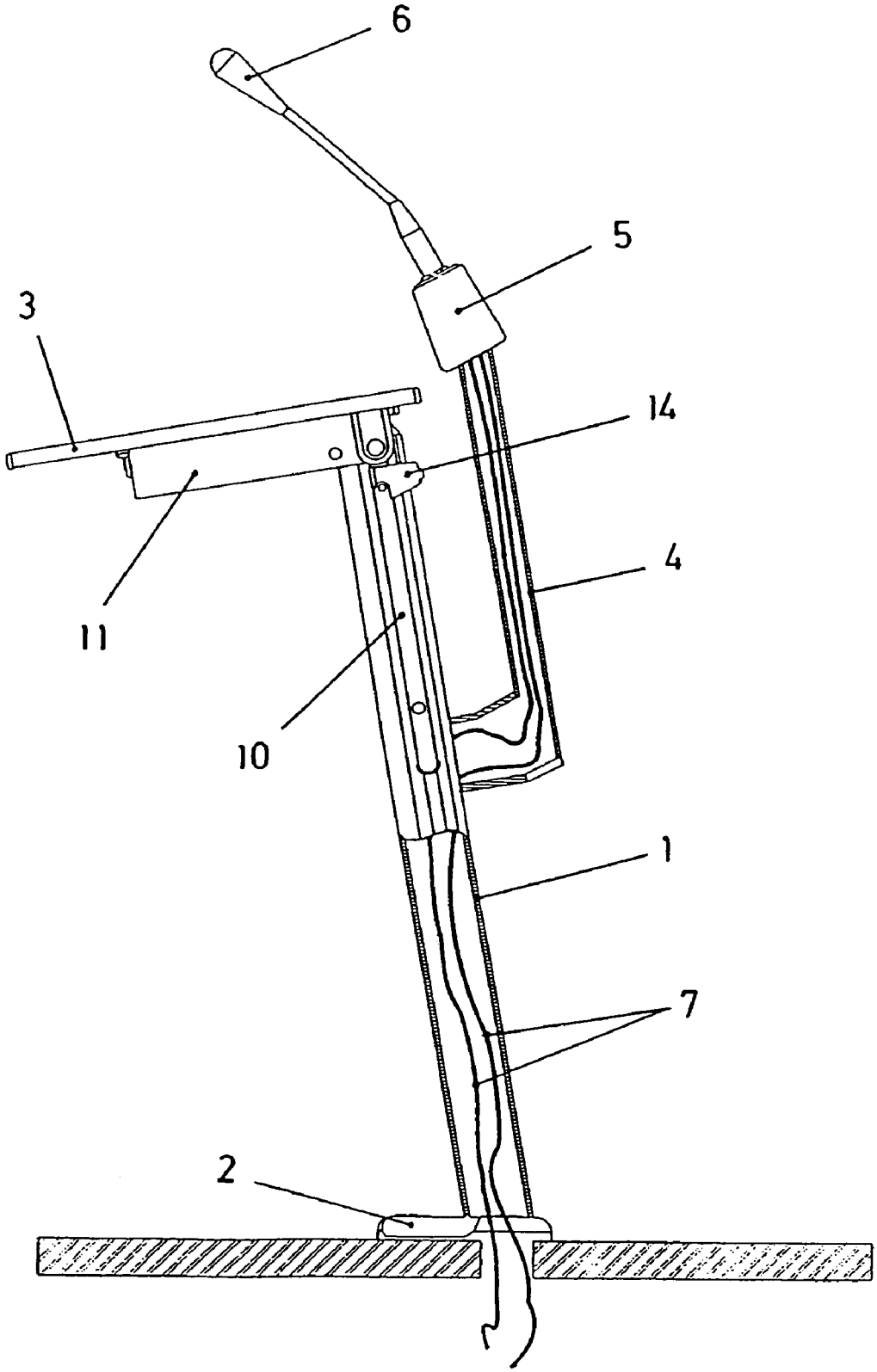
FIG. 4 is a side view of the deployed table, with partial cutting to appreciate the internal inclusion of the connection cables for the microphone module.
Figure 6:
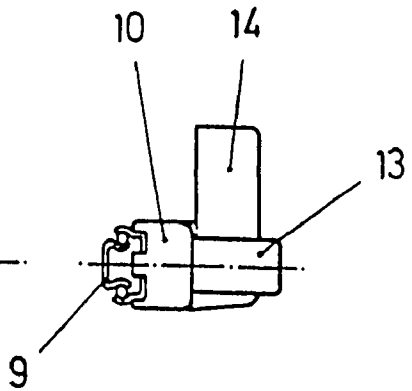
FIGS. 5, 6 and 7 are all corresponding view in side profile and in plant of one of the fastening fittings of the tiltable board of the table.
Figure 5:
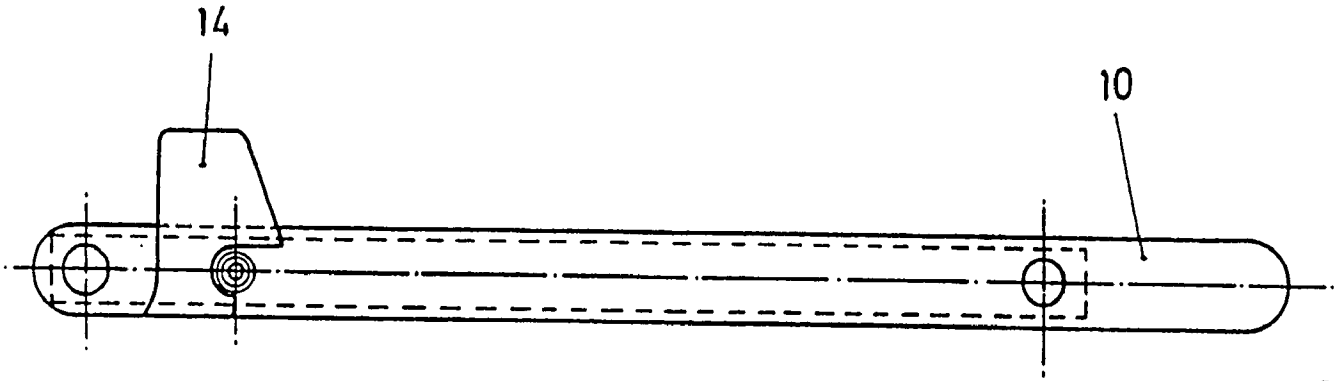
Figure 7:
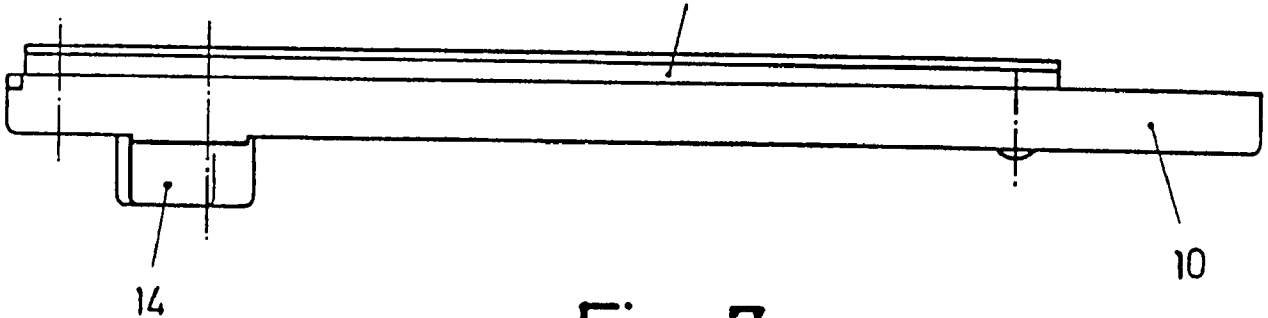
Figure 8:
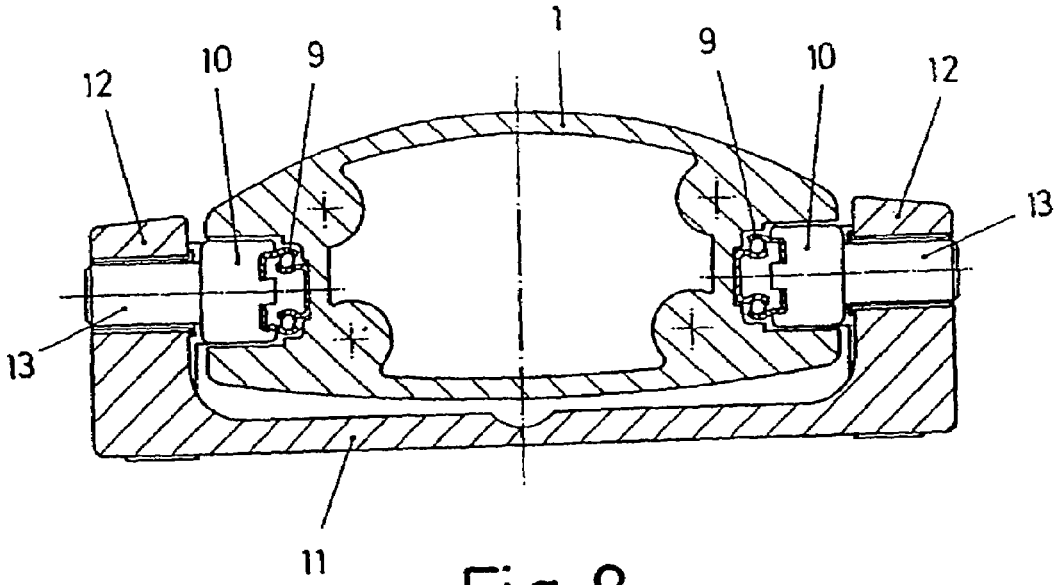
FIG. 8 is an enlarged view in traverse section of the bearing column of the table at the assembly area of the bearing part of the tiltable board.

The connection of the module (5) is established by means of cables (7) which are included at the inside of the support (4) and the column (1), in the way represented on FIG. 4, so that at the outside no loose elements can suppose a nuisance or be the cause of accidental trips.

The bearing column (1) consists in a profile that determines at the sides some longitudinal grooves (8) in which both ball guides (9) are included, above which some fittings (10) are incorporated which remain this way in sliding disposition along the mentioned grooves (8).

On the other hand, the board (3) is fixed to a bearing part (11) which determines some conformations (12) in which the respective outstanding revolvable pivots (13) of the fittings (10) are fitted.

Figure 3:
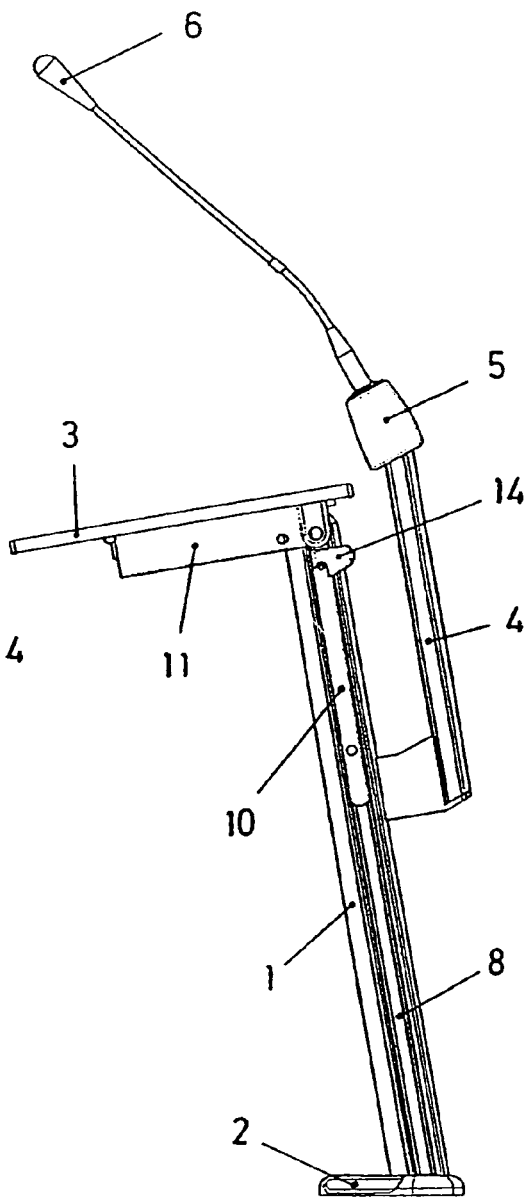
FIG. 3 is a side view of the table in deployed position.

This way, the board (3) remains with articulable play with respect to the fittings (10) while these are slidable along the grooves (8) of the column (1), so that by means of the upward sliding movement of the fittings (10) the board falls towards the front, till a horizontal, or slightly inclined position is reached, which corresponds to the usable disposition of the table, according to FIGS. 1, 3 and 4.

Figure 2:
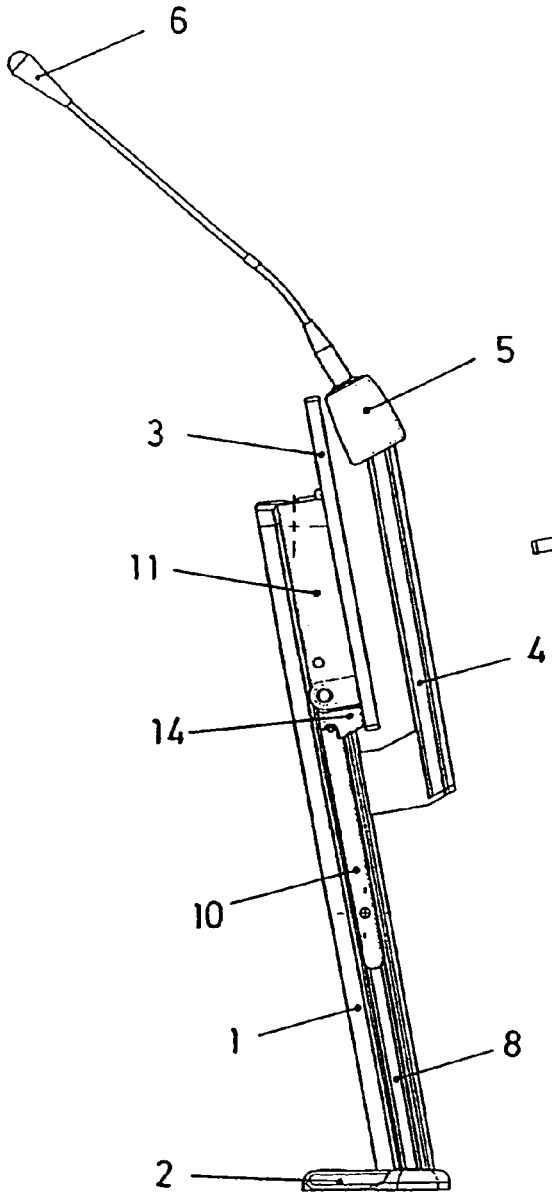
FIG. 2 is a side view of the table in folded position.

On the contrary, when the fittings (10) are moved downwards, the board (3) is retracted to the back, being forced to tilt until a parallel position respect to the column (1) situated at its back is reached, according to FIG. 2.

In the lowered position towards the front the board (3) is maintained stable by the support of the bearing support (11) on the upper end of the column (1); while in the withdrawn position behind the column (1) the board (3) is maintained at the upper part as the dimension of the guides (9) itself determines a sliding limit of the fittings (10), not allowing the fall till the lower part, while the conformation (14) of the fittings (10) prevents the overturning of the board (3) back in that position.

In this withdrawn position, the board (3) is included between the column (1) and the bearing support (4) of the module (5), so that the incorporation of the microphone (6)

does not affect the functional tilting of the mentioned board (3) in any way between the respective positions of use and folding of the table.

On the other hand, the bearing part (11) of the board (3) establishes a guided conduction in sliding support over the end of the column (1), achieving this way a levelling which is maintained without sideward deviations when the board (3) is tilted between the two practical positions of the table.

This way a table results that can be installed in an individual way in any place, or be used by itself as an oratorical point, being it possible to incorporate it in connection with seats for its use from the sitting position, with the possibility to situate it to be used from the corresponding seat and be folded in its folding disposition to leave the space free, for example to allow the movement between the continuous rows of seat without disturbing in rooms dedicated to conferences, congresses, etc. . . .

The folding and unfolding of the board (3) between the two practical positions of the table are moreover easy to be carried out, since it is only necessary to pull the board itself (3) up and to the front to situated it into its position of use; while to fold it into its withdrawn position, it is only necessary to push the mentioned board (3) towards the back, with which the sliding takes place and it falls back to its parallel position behind the column (1).

The fittings (10) and the supporting part (11) of the board (3) cover the guides (9) in a permanent way, so that a protection is reached which prevents that the users' clothing can get stainedor get caught in the mentioned guides (9), without damaging the necessary lubrication of the latter.

Figure 9:
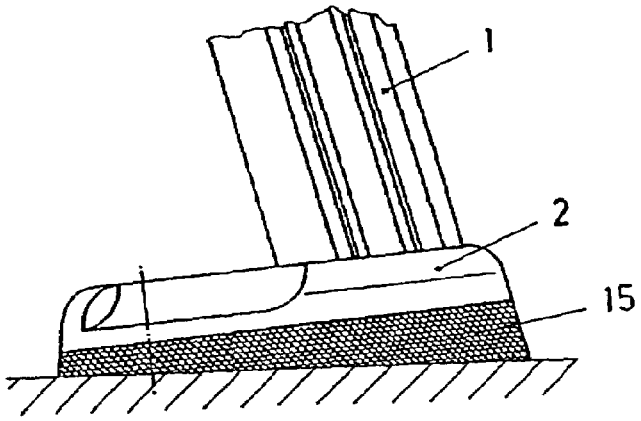
FIG. 9 is an enlarged side view of the lower end of the bearing column, with inclusion of a supplementary levelling wedge.

Beyond the base (2) for its fixing to the floor, in its case accessory wedges (15) can be incorporated, in the way shown on FIG. 9, for a levelling supplement when the table is placed on inclined floors, with the purpose that in its lowered position to be used, the board (3) remains in the foreseen position.

What is claimed is:

1. Improved lectern table, comprising:

a bearing column (1), which at its lower end has a base (2) adapted to be fixed to a floor, and at its upper end, a board (3) is connected to a tiltable assembly;

a support (4) having the shape of an arm directed substantially upwards connected to said bearing column and defining an intermedium space therebetween adapted to receive said board in a substantially vertically folded-back stowed position, said support further having, at its upper end and above the board, a module (5), to receive a microphone (6).

2. Improved lectern table, according to the first claim, characterized in that the board (3) is revolvably articulated relative to said bearing column by slide fittings (10) disposed along the sides of the column (1), which with their movement determine the tilt of the board (3) between a lowered forward position and the folded-back stowed position in which the board is disposed between the column (1) and the support (4).

3. Improved lectern table, according to the first claim, characterized in that a connection of the module (5) bearing the microphone (6) is established by cables (7) disposed in a passage inside the column (1) and the support (4).

4. Improved lectern table, according to the first claim, characterized in that the board (3) remains fixed on a tiltable bearing support (11), that guides said board with respect to the upper end of the column (1); while in the folded-back position has a tilt stop against some conformations (14) of slide fittings (10).

5. Improved lectern table, according to the first claim, characterized in that below the base (2) accessory wedges (15) can be incorporated to compensate for differences of elevation in installations on inclined floors.

* * * * *